US010421471B2

(12) United States Patent
Bollapragada et al.

(10) Patent No.: US 10,421,471 B2
(45) Date of Patent: Sep. 24, 2019

(54) POWER ASSIGNMENT SYSTEM AND METHOD FOR FORMING VEHICLE SYSTEMS

(71) Applicant: GENERAL ELECTRIC COMPANY, Schenectady, NY (US)

(72) Inventors: Srinivas Bollapragada, Niskayuna, NY (US); Vinayak Tilak, Bangalore (IN); Vinaykanth Mudiam, Lawrence Park, PA (US); Rajeev Namboothiri, Bangalore (IN)

(73) Assignee: GE GLOBAL SOURCING LLC, Norwalk, CT (US)

( * ) Notice: Subject to any disclaimer, the term of this patent is extended or adjusted under 35 U.S.C. 154(b) by 838 days.

(21) Appl. No.: 14/492,226

(22) Filed: Sep. 22, 2014

(65) Prior Publication Data

US 2016/0082992 A1 Mar. 24, 2016

(51) Int. Cl.
*B61L 27/00* (2006.01)

(52) U.S. Cl.
CPC ..... *B61L 27/0027* (2013.01)

(58) Field of Classification Search
CPC ..... B61L 27/0027
See application file for complete search history.

(56) References Cited

U.S. PATENT DOCUMENTS 6,225,919 B1 5/2001 Lumbis et al.
2003/0213875 A1 11/2003 Hess et al.
2010/0262321 A1* 10/2010 Daum ..... B61L 3/006 701/20
2011/0060486 A1 3/2011 Meltser et al.
2012/0245766 A1 9/2012 Cooper et al.
2012/0277940 A1 11/2012 Kumar et al.
2013/0006451 A1* 1/2013 Cooper ..... B61L 3/006 701/19
2013/0200222 A1 8/2013 Cooper
2014/0025414 A1 1/2014 Worden et al.
2015/0066561 A1 3/2015 Wills et al.

FOREIGN PATENT DOCUMENTS

RU 2501695 C2 9/2009

OTHER PUBLICATIONS http://optym.com/railway/yardmax; OPTYM Live Efficiently; 3 pgs.
http://optym.com/railway/locomax; OPTYM Live Efficiently; 3 pgs.
http://optym.com/railway/yardsym; OPTYM Live Efficiently; 3 pgs.
(Continued)

*Primary Examiner* — Imran K Mustafa
(74) *Attorney, Agent, or Firm* — Christopher R. Carroll; The Small Patent Law Group LLC

(57) ABSTRACT

A power assignment system and method determine a needed amount of power for propelling a vehicle system along a route and identify propulsion-generating vehicles for inclusion in the vehicle system based on power capabilities of the one or more propulsion-generating vehicles. Handling parameters of the vehicle system are determined for different groups of the propulsion-generating vehicles, and the propulsion-generating vehicles in at least one of the groups are selected based on the handling parameters. The selected propulsion-generating vehicles are included in the vehicle system during actual travel of the vehicle system along the route during the trip.

20 Claims, 4 Drawing Sheets

(56) References Cited

OTHER PUBLICATIONS http://optym.com/railway/railviewr; OPTYM Live Efficiently; 4 pgs.
http://optym.com/railway/railbis; OPTYM Live Efficiently; 3 pgs.
http://optym.com/railway/crewdesign; OPTYM Live Efficiently; 4 pgs.
http://optym.com/railway/trainmax; OPTYM Live Efficiently; 3 pgs.
http://optym.com/railway; OPTYM Live Efficiently; 6 pgs.
http://optym.com; From the Ground; OPTYM Live Efficiently; 5 pgs.
Ahuja, Ravindra; Liu, Jian; Orlin, James; Sharma, Dushyant; Shughart, Larry; "Solving Real-Life Locomotive Scheduling Problems", Apr. 11, 2002; 35 pgs.
Unofficial translation of office action issued on behalf of KZ Patent Application No. 2015/1022.1 dated Oct. 7, 2016.

* cited by examiner

POWER ASSIGNMENT SYSTEM AND METHOD FOR FORMING VEHICLE SYSTEMS

FIELD

Embodiments of the subject matter disclosed herein relate to determining which propulsion-generating vehicles are to be included in a vehicle system formed from one or more of the propulsion-generating vehicles and optionally one or more non-propulsion-generating vehicles.

BACKGROUND

Some existing energy management systems can be used to control operations of vehicle systems during a trip to "optimize" performance of the vehicle systems. For example, Trip Optimizer™ provided by General Electric Company can be used to automatically control throttles of locomotives in a rail vehicle system to assist in keeping the rail vehicle systems on schedule while reducing fuel consumption and/or emission generation (relative to operating the locomotives without using Trip Optimizer™). These types of energy management systems can take into account factors such as length of the rail vehicle system, weight of the rail vehicle system, grade of the route being traveled upon, conditions of the route, weather conditions, and performance characteristics of the vehicles. The energy management systems create trip profiles or trip plans that reduce braking and can reduce the fuel consumed and/or emissions generated.

The data that is input into the energy management system can include the vehicles that are included in the rail vehicle system. Building the rail vehicle systems by determining an order of non-propulsion-generating vehicles (e.g., railcars) in the rail vehicle system, the propulsion-generating vehicles included in the rail vehicle system, and/or using distributed power (DP) controls can further decrease fuel consumption. Toward this end, some vehicle yards (e.g., rail yards) include yard planning systems that determine the vehicles assigned to a vehicle system by following various rules, such as block ordering, handling rules, or the like. These yard planning systems, however, may not assign propulsion-generating vehicles to the vehicle systems and/or select locations for the propulsion-generating vehicles in the vehicle system. Typically, these assignments are carried out manually, and may inefficiently assign propulsion-generating vehicles to the vehicle systems. As a result, the vehicle systems may consume more fuel than necessary, operate less efficiently, experience more road failures, and the like, than if the assignment and/or locations of the propulsion-generating vehicles in the vehicle system were performed in another manner.

BRIEF DESCRIPTION

In one embodiment, a method (e.g., for forming vehicle systems) includes determining a needed amount of power for propelling a vehicle system along a route during a trip from a first location to one or more destination locations and identifying one or more propulsion-generating vehicles for inclusion in the vehicle system based on power capabilities of the one or more propulsion-generating vehicles. The power capabilities are representative of amounts of power that the one or more propulsion-generating vehicles are calculated to be capable of providing. The method also can include determining handling parameters of the vehicle system having a first group of the one or more propulsion-generating vehicles generating propulsive force to move the vehicle system along the route during the trip, repeating determining the handling parameters of the vehicle system with the vehicle system having one or more different groups of the one or more propulsion-generating vehicles generating the propulsive force to move the vehicle system along the route during the trip, and selecting the one or more propulsion-generating vehicles in at least one of the first group or the one or more different groups based on the handling parameters. The one or more propulsion-generating vehicles are selected for inclusion in the vehicle system during actual travel of the vehicle system along the route during the trip.

In another embodiment, a system (e.g., a power assignment system) includes one or more processors configured to determine a needed amount of power for propelling a vehicle system along a route during a trip from a first location to one or more destination locations. The one or more processors also are configured to identify one or more propulsion-generating vehicles for inclusion in the vehicle system based on power capabilities of the one or more propulsion-generating vehicles. The power capabilities are representative of amounts of power that the one or more propulsion-generating vehicles are calculated to be capable of providing. The one or more processors also can be configured to determine handling parameters of the vehicle system having a first group of the one or more propulsion-generating vehicles generating propulsive force to move the vehicle system along the route during the trip, and to repeat determining the handling parameters of the vehicle system with the vehicle system having one or more different groups of the one or more propulsion-generating vehicles generating the propulsive force to move the vehicle system along the route during the trip. The one or more processors also can be configured to select the one or more propulsion-generating vehicles in at least one of the first group or the one or more different groups based on the handling parameters. The one or more propulsion-generating vehicles are selected for inclusion in the vehicle system during actual travel of the vehicle system along the route during the trip.

In another embodiment, method (e.g., for forming vehicle systems) includes comparing an amount of tractive power needed to travel to a location along a route using a vehicle system comprising plural non-propulsion-generating vehicles with power capabilities of available propulsion-generating vehicles that are available for inclusion in the vehicle system, and selecting a subset of the available propulsion-generating vehicles for inclusion in the vehicle system. The subset of the available propulsion-generating vehicles provides at least the amount of tractive power needed to travel to the location. The method also can include examining handling parameters of the vehicle system with different arrangements of the available propulsion-generating vehicles in the vehicle system, and selecting a first arrangement of the different arrangements of the available propulsion-generating vehicles for inclusion in the vehicle system during actual travel of the vehicle system along the route toward the location.

BRIEF DESCRIPTION OF THE DRAWINGS

Reference is made to the accompanying drawings in which particular embodiments and further benefits of the invention are illustrated as described in more detail in the description below, in which.

DETAILED DESCRIPTION

Figure 1:
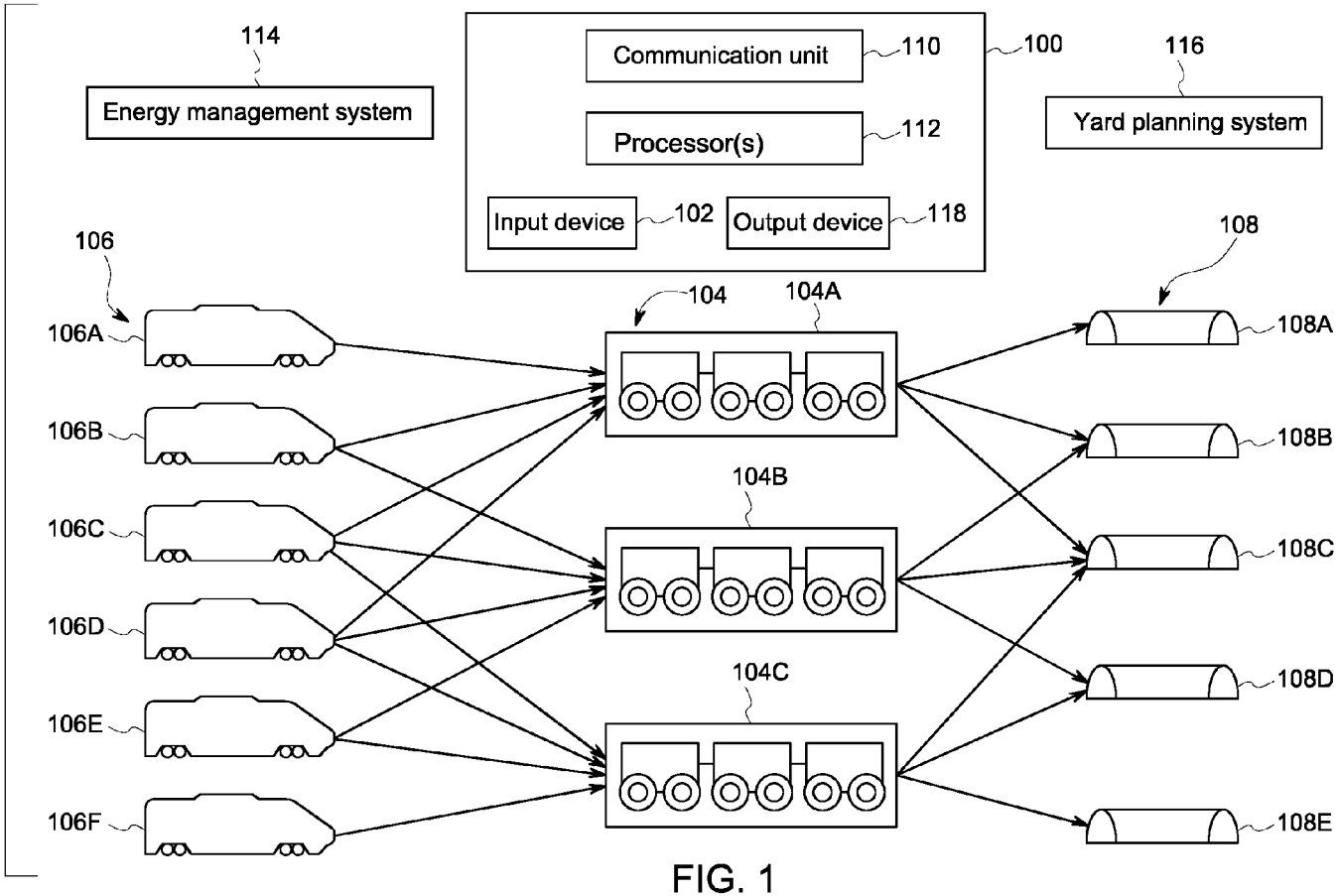
FIG. 1 schematically illustrates a power assignment system according to one embodiment of the inventive subject matter.

FIG. 1 schematically illustrates a power assignment system 100 according to one embodiment of the inventive subject matter. The power assignment system 100 may be formed from one or more computer components, such as one or more processors, displays, or the like, that operate pursuant to instructions included in one or more computer readable storage medium. These instructions may cause the computer components to operate in a specific, novel, and non-obvious manner as described herein. Optionally, the computer components may be specialized components that are manufactured to carry out the operations described herein. For example, at least some of the instructions may be hard-wired to the computer components.

In one embodiment, the power assignment system 100 receives input data related to an upcoming trip of a vehicle system, determines how much power is needed to complete the trip, and assigns propulsion-generating vehicles to the vehicle system such that the power needed to complete the trip is met by the propulsion-generating vehicles without exceeding this needed power by a significant amount. The power assignment system 100 optionally may identify locations in the vehicle system for the propulsion-generating vehicles, such as by assigning different locations for the propulsion-generating vehicles so that the distribution of the propulsion-generating vehicles among the non-propulsion-generating vehicles in the vehicle system is controlled.

The propulsion-generating vehicles may be selected from the vehicles that are currently available at a vehicle yard from which the vehicle system will depart for the upcoming trip. Optionally, the power assignment system 100 may communicate with one or more other vehicle systems and/or vehicle yards in order to identify inbound vehicle systems having additional propulsion-generating vehicles traveling toward the vehicle yard from which the vehicle system will depart for the trip. The power assignment system 100 can examine these additional propulsion-generating vehicles to determine if any of these vehicles should be included in the vehicle system for the upcoming trip.

The selection of which propulsion-generating vehicles are included may be at least partially based on health of the propulsion-generating vehicles. For example, over time, the amount of power that actually can be provided by the vehicles may change. With increasing age, wear, damage, use, or the like, the actual power provided by a vehicle may decrease. The decreased power provided by the vehicle may be represented by a quantitative health score or index that represents the amount of decreased power and/or the amount of power that the vehicle is actually able to provide. In one embodiment, the health score may be calculated according to one or more embodiments of calculating health scores as described in U.S. patent application Ser. No. 13/554,808, the entire disclosure of which is incorporated herein by reference.

The propulsion-generating vehicles can base which propulsion-generating vehicles are included in the vehicle system based on a priority of cargo to be carried by the vehicle system. If the vehicle system has cargo with a sufficiently high priority (e.g., the financial value of the cargo or the shipping contract exceeds a designated threshold value, a priority index assigned to the cargo exceeds a designated threshold value, or the like), then the power assignment system 100 may select propulsion-generating vehicles for inclusion in the vehicle system that are newer than other propulsion-generating vehicles, that have larger power output capabilities than other propulsion-generating vehicles, that have been more recently repaired, inspected, maintained, or the like, than other propulsion-generating vehicles, etc.

The power assignment system 100 can simulate the trip with different combinations and/or distributions of the propulsion-generating vehicles in the vehicle system. The propulsion-generating vehicles that are used in the different simulations may be selected from a larger group of vehicles such that the selected vehicles have power output capabilities that meet or exceed the amount of power needed to complete the trip, without providing a significant amount of excess power. For example, the selected vehicles may provide at least the needed amount of power, without exceeding this amount of power by more than 1%, 5%, 10%, or another value.

The power assignment system 100 can simulate travel of the vehicle system with the assigned propulsion-generating vehicles in order to estimate handling parameters of the vehicle system. Handling parameters represent how easy or difficult it can be to control the vehicle system, and can include factors such as forces imparted on the vehicles, forces imparted on couplers that mechanically connect neighboring vehicles in the vehicle system, momenta of the vehicles, adhesion between wheels of the vehicles and the route being traveled upon, or the like.

Based on these simulations, the power assignment system 100 may select one group of the propulsion-generating vehicles over other groups for inclusion in the vehicle system during actual travel. For example, the group of propulsion-generating vehicles having lower handling parameters, lower fuel consumption, lower emission generation, or the like, than one or more other groups of the propulsion-generating vehicles may be selected for inclusion in the vehicle system during actual travel.

The propulsion-generating vehicles that are included in the vehicle system may be modified at one or more locations along the trip. For example, after the vehicle system arrives at another vehicle yard during the trip, the power assignment system 100 may identify one or more other propulsion-generating vehicles to be included in the vehicle system, in place of and/or in addition to the propulsion-generating vehicles in the vehicle system. The power assignment system 100 can make this identification by repeating the determining of how much power is needed to complete the trip or an upcoming segment of the trip, identifying currently available propulsion-generating vehicles and/or vehicles that will be available in the future, and simulating travel of different groups of the propulsion-generating vehicles. The propulsion-generating vehicles in the vehicle system may then be modified. In doing so, the power assignment system 100 may repeatedly re-examine the vehicle system to determine if a different group and/or distribution of propulsion-generating vehicles in the vehicle system can operate more efficiently than a current group and/or distribution of the propulsion-generating vehicles in the vehicle system.

The power assignment system 100 includes an input device 102 that obtains data representative of a trip of one or more vehicle systems 104 (e.g., vehicle systems 104A-C) and/or representative of a vehicle system 104. The input device 102 can include one or more computer components that operate to receive information from an operator of the power assignment system 100, from one or more sensors, or the like. For example, the input device 102 can include an electronic mouse, a stylus, a microphone, a touchscreen, a keyboard, or the like. Optionally, the input device 102 can include or represent one or more computer readable storage media, such as a computer hard drive, a magnetic disk drive, flash memory, read only memory (including programmable ROM, electronically programmable ROM, electronically erasable programmable ROM, etc.), dynamic random access memory, or the like. The input device 102 can obtain the data by accessing the data stored in such a computer readable medium.

Optionally, a communication unit 110 of the power assignment system 100 can obtain at least some of the data related to the trip and/or vehicle system 104. The communication unit 110 represents electronic hardware, such as transceiving equipment, one or more antenna, one or more cables, associated electronic circuitry, or the like. The communication unit 110 can receive data related to the trip and/or vehicle systems 104 from one or more other communication units (e.g., at various vehicle yards, dispatch centers, vehicles, etc.).

The power assignment system 100 also includes one or more processors 112 that determine which propulsion-generating vehicles to include in which vehicle systems 104. The processors 112 can represent electronic circuitry that includes and/or is connected with one or more microprocessors. The processors 112 can operate pursuant to hard-wired instructions and/or instructions stored on computer readable media, such as a memory of the input device 102. One example of the operations performed by the processors 112 can be represented by flowcharts of methods described herein.

Figure 2A:
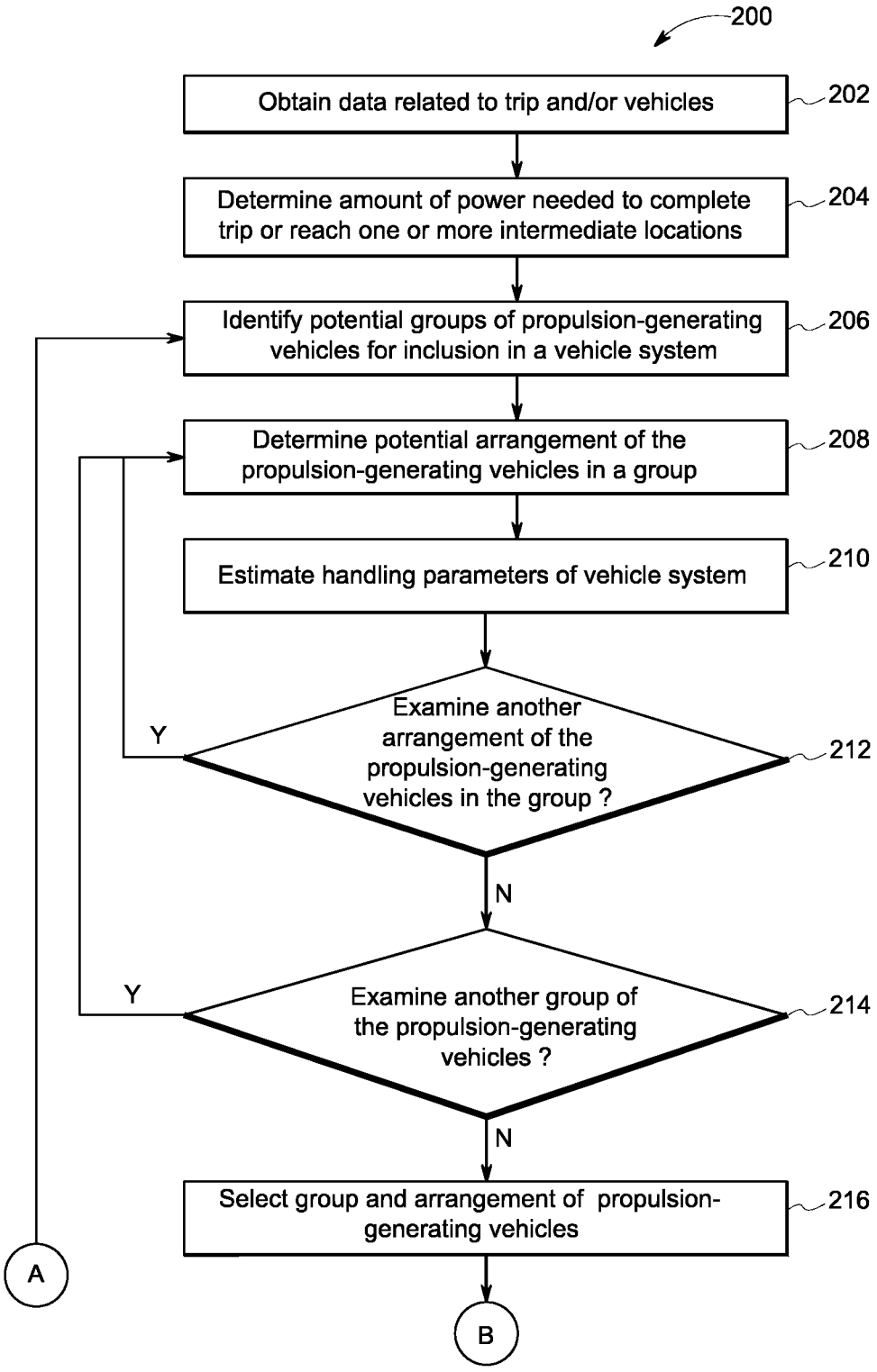
FIGS. 2A and 2B illustrate a flowchart of a method for assigning power (e.g., propulsion-generating vehicles) to one or more vehicle systems according to one embodiment.
Figure 2B:
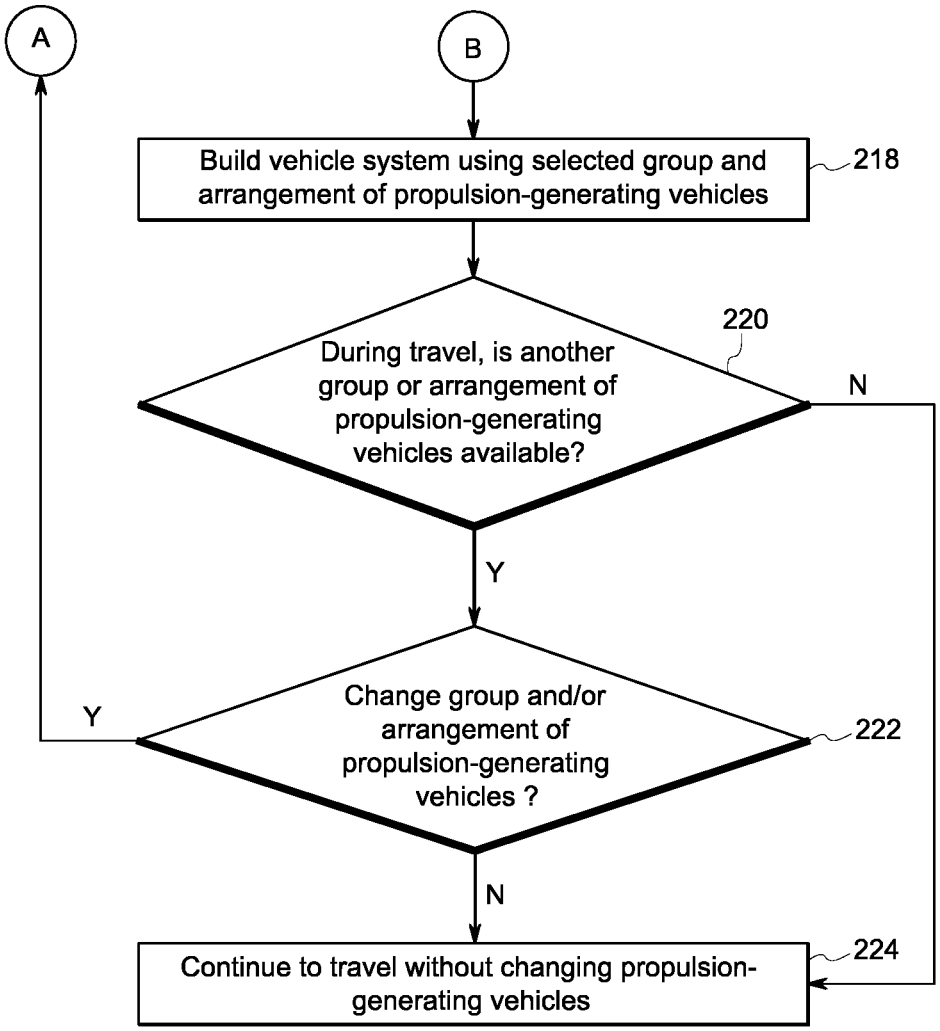

With continued reference to the power assignment system 100 shown in FIG. 1, FIGS. 2A and 2B illustrate a flowchart of a method 200 for assigning power (e.g., propulsion-generating vehicles) to one or more vehicle systems according to one embodiment. The method 200 may be performed by the power assignment system 100 in one embodiment. At 202, data related to a current or upcoming trip of a vehicle system is obtained and/or data related to the vehicle system to perform the trip are obtained. This data can be obtained by the input device 102. The data related to the trip can include an origin location of a trip of the vehicle system 104 and/or one or more destination locations 108 (e.g., locations 108A-E) of the trip (e.g., a final destination and/or intermediate locations between the origin location and the final destination location). The data received by the input device 102 related to the vehicle systems 104 can include an expected set of non-propulsion-generating vehicles (e.g., railcars) for the vehicle systems 104 and/or a pool of available propulsion-generating vehicles 106 (e.g., vehicles 106A-F). While the description herein focuses on rail vehicles, alternatively, the inventive subject matter described herein may be used with other types of vehicles, such as automobiles (e.g., a platoon of tractor trailers operating in conjunction with each other), mining vehicles, or the like.

In one embodiment, the power assignment system 100 obtains data related to the trip and/or data related to the vehicle system from an energy management system 114 and/or a yard planning system 116. The energy management system 114 represents one or more computer components, such as one or more processors, hardware circuits, and/or computer readable storage media, which formulate trip plans for vehicle systems 104. The trip plans can be based on the data related to the trip, such as grades, curvatures, and the like, of the route to be traveled upon for the trip, the data related to the vehicle system, and/or other data. The trip plans can include operational settings (e.g., throttle settings, brake settings, speeds, or the like) of the vehicle system that are designated as a function of time and/or distance along the route during the trip. Traveling according to the trip plan can reduce fuel consumed and/or emissions generated by the vehicle system relative to traveling according to other settings.

The yard planning system 116 represents one or more computer components, such as one or more processors, hardware circuits, and/or computer readable storage media, that formulate yard plans for vehicle systems 104 in a vehicle yard, such as a rail yard or other location where multiple vehicle systems 104 may be processed for upcoming trips. The yard plans can be based on the data related to the vehicle systems, scheduled trips, trip plans, or the like. The yard plans can dictate operations to be performed on the vehicle systems 104 and/or vehicles that form the vehicle systems 104 to receive the vehicle systems 104 into the yard, separate the vehicles in the vehicle systems 104, combine the vehicles into the same or different vehicle systems 104, examine the vehicles or vehicle systems 104, maintain the vehicles or vehicle systems 104, repair the vehicles or vehicle systems 104, or otherwise prepare the vehicles for departure from the vehicle yard in the vehicle systems 104.

At 204, an amount of power needed to complete a trip and/or reach one or more intermediate locations along the route for a trip of a vehicle system 104 is determined. This amount of power can represent the total horsepower, total horsepower per ton, or other measurement of motive power or effort that is calculated, estimated, or measured as being needed to propel a vehicle system 104 to a final destination of a trip and/or an intermediate location in the trip.

The amount of needed power may be determined based on a variety of information, such as the vehicles that are included in the vehicle system 104 (e.g., the size, weight, and/or location of each locomotive, railcar, or other vehicle in the vehicle system 104), the terrain (e.g., grade, curvature, or the like) of the route to be traveled during the trip, or other information. For example, for longer trips, heavier vehicle systems 104, trips that travel over larger uphill grades, trips with more curves in the route, or the like, the total amount of needed power may be larger than for shorter trips, lighter vehicle systems 104, fewer and/or smaller uphill grades, fewer curves, and the like. The information on which the amount of needed power is based can be obtained from the energy management system 114 (e.g., from a trip plan of an upcoming trip), from a route database (e.g., as part of the memory in the input device 102) that stores grades, curvatures, or the like, of the route, from the yard planning system 116, or from another location.

At 206, potential groups of propulsion-generating vehicles 106 for inclusion in the vehicle system 104 are identified. The groups may be identified by selecting different propulsion-generating vehicles 106 for each group, determining how much power can be provided by each of the propulsion-generating vehicles 106 in the group, and calculating, estimating, or measuring how much total power can be provided by the vehicles 106 in the group. The groups may differ from each other in that different groups may have different propulsion-generating vehicles 106 and/or have one or more of the same propulsion-generating vehicles 106, but in different locations in the vehicle system 104. For example, a first group may have a first propulsion-generating vehicle 106 ahead of second and third propulsion-generating vehicles 106 (along a direction of planned travel) and separated from the second vehicle 106 by two non-propulsion-generating vehicles and separated from the third vehicle 106 by the same two non-propulsion-generating vehicles and the second vehicle 106. A different, second group may include one or more different propulsion-generating vehicles 106, or may include the first vehicle 106 between the second and third vehicles 106, the first vehicle 106 separated from the second and/or third vehicle 106 by a different number of other vehicles, or the like.

As described below, the different groups of the propulsion-generating vehicles 106 may be examined by estimating handling parameters of the vehicle systems 104 that include the different groups of the vehicles 106 during simulations of travel along the route for the trip. The vehicles 106 that are included in the different groups may be selected from currently available propulsion-generating vehicles 106 (e.g., vehicles 106 that currently are in a vehicle yard from which the vehicle system 104 is scheduled to depart for the trip or an upcoming segment of the trip). Optionally, the vehicles 106 that may be included in one or more of the groups may include vehicles 106 that are not yet currently available for being included in a vehicle system 104, but that are expected (e.g., scheduled) to be available at a future time. For example, a propulsion-generating vehicle 106 that currently is being examined, maintained, repaired, or the like, in the vehicle yard may not yet be available for departure in a vehicle system 104, but may be scheduled to be ready to be available for departure in the vehicle system 104 at an upcoming time. As another example, one or more vehicle systems 104 may be traveling toward the vehicle yard and may be scheduled to arrive at an upcoming arrival time. One or more propulsion-generating vehicles 106 in these vehicle systems may be included in the groups. Alternatively, the groups may be formed with only those vehicles 106 that are currently available in the vehicle yard.

In one embodiment, one or more constraints may be applied to the selection of propulsion-generating vehicles 106 for inclusion in the groups. These constraints may prevent some propulsion-generating vehicles 106 from being included in the groups and/or may prevent some combinations of the vehicles 106 from being combined with each other in a group. One example of a constraint may be a lower total power requirement. This constraint may require that the combination of propulsion-generating vehicles 106 in a group provide at least the amount of power calculated, estimated, measured, or otherwise determined as being needed to complete the trip and/or to reach one or more intermediate locations along the route during the trip. This constraint may consider the health of the propulsion-generating vehicles 106. For example, quantitative health scores or indices that represent the amounts of decreased power and/or the amounts of power that the vehicles 106 are actually able to provide can be taken into consideration.

Another example of a constraint may be a future scheduled event limitation. This constraint may consider upcoming events that are scheduled for one or more of the propulsion-generating vehicles 106 and can eliminate vehicles 106 from inclusion in one or more potential groups of the vehicles 106 for a vehicle system 104 based on the upcoming events. For example, some of the propulsion-generating vehicles 106 may be scheduled for maintenance, repair, inspection, or the like, at future dates and/or times. The scheduled event may be sooner than a trip for the vehicle system 104 will be completed for one or more of the propulsion-generating vehicles 106. These vehicles 106 may be excluded from the groups in order to prevent consideration of these vehicles 106 in the vehicle system 104 as the vehicle system 104 is likely to not complete the scheduled trip prior to the scheduled maintenance, repair, inspection, or the like, of the vehicles 106.

Optionally, the vehicle systems 104 for which the propulsion-generating vehicles 106 that are scheduled for an event may be restricted. For example, a first propulsion-generating vehicle 106 may only be considered for inclusion in one or more groups being examined for those vehicle systems 104 that do not have a trip scheduled until after a scheduled maintenance, repair, inspection, or the like, of the first vehicle 106 and/or that have a trip scheduled to be completed prior to the scheduled maintenance, repair, inspection, or the like, of the first vehicle 106. In one embodiment, the first vehicle 106 may not be included in any groups being considered for a vehicle system 104 having a trip that would prevent the first vehicle 106 from arriving at a location for the scheduled maintenance, repair, inspection, or the like.

Figure 3:
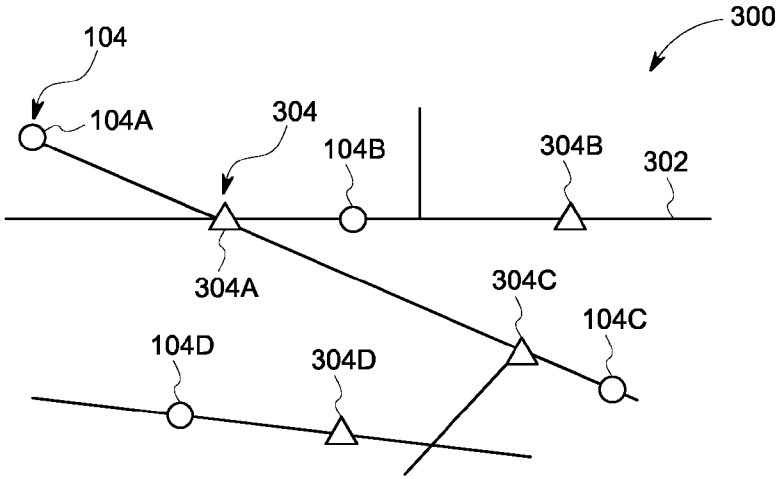
FIG. 3 illustrates one example of a transportation network formed from plural connected and/or interconnected routes.

The vehicles 106 may only be considered for inclusion in groups that are being examined for a vehicle system 104 that is scheduled to travel toward and/or arrive at one or more vehicle yards or other locations where the scheduled event is to occur for the vehicles 106. FIG. 3 illustrates one example of a transportation network 300 formed from plural connected and/or interconnected routes 302. Several vehicle systems 104 (e.g., vehicle systems 104A-D) are represented by circles and several vehicle yards 304 (e.g., vehicle yards 304A-D) are represented by triangles in FIG. 3. In one example, the vehicle system 104A may be scheduled to travel to the vehicle yard 304A and then the vehicle yard 304C. The propulsion-generating vehicles 106 that are scheduled for an event prior to the vehicle system 104A arriving at the vehicle yard 304A and/or 304C may be excluded from the groups of the propulsion-generating vehicles 106 being considered for inclusion in the vehicle system 104A. If one or more of the vehicles 106 are scheduled for the event at the yard 304A and/or 304C, then these vehicles 106 may be included in the groups. The propulsion-generating vehicles 106 that are scheduled for an event after the vehicle system 104A arrives at the vehicle yard 304A and/or 304C may be included in the groups of the vehicles 106 being considered for inclusion in the vehicle system 104A.

Another constraint that may be considered may be capacity limitations of the vehicle yards 304. The vehicle yards 304 may be limited in terms of how many vehicles 106 and/or non-propulsion-generating vehicles can be in a vehicle yard 304 at the same time, how many vehicles can be maintained, repaired, inspected, or the like, at the same time, etc. In determining which propulsion-generating vehicles 106 are considered for inclusion in one or more of the groups for a vehicle system 104, those vehicles 106 that would cause one or more yards 304 along a trip of the vehicle system 104 to exceed capacity limitations of the yards 304 may be excluded from consideration for inclusion in the groups. For example, if a vehicle system 104D is scheduled to travel to and arrive at the vehicle yard 304D at a scheduled time, then the capacity of the vehicle yard 304D can be calculated or estimated for the scheduled time (e.g., based on schedules of the vehicle yard 304D and/or other vehicle systems 104). This capacity can be examined to determine if the capacity is sufficiently large to receive the vehicle system 104D with the propulsion-generating vehicles 106 being considered for inclusion in the vehicle system 104D. If inclusion in one or more of the vehicles 106 in the vehicle system 104D would cause the vehicle yard 304D to exceed a capacity limitation, then those vehicles 106 may be excluded from consideration for inclusion in the vehicle system 104D.

Another example of a constraint on which propulsion-generating vehicles 106 may be included in a vehicle system 104 may include a consist-busting limitation. Some vehicle systems 104 that are heading to a vehicle yard 304 may include two or more propulsion-generating vehicles 106 that are directly mechanically coupled to each other, such as by couplers connected to the adjacent vehicles 106. These vehicles 106 may be referred to as a consist. When the vehicle system 104 is received in a vehicle yard 304, the propulsion-generating vehicles and non-propulsion-generating vehicles in the vehicle system 104 may be separated from each other and combined with other vehicles to form other vehicle systems 104 for departure from the vehicle yard 304. In determining whether the propulsion-generating vehicles 106 in a vehicle system 104 are to be included in any groups for consideration in including the vehicles 106 in another vehicle system 104, the consist-busting limitation may prevent those vehicles 106 that are included in a consist from being separated from each other.

For example, the vehicle system 104B may be headed toward the vehicle yard 304A and may include a consist formed from first and second propulsion-generating vehicles 106 that are directly connected with each other by a coupler. Another vehicle system 104 (e.g., a second vehicle system 104) may be scheduled for departure from the vehicle yard 304A. In one embodiment, during identification of propulsion-generating vehicles 106 that may be included in this second vehicle system 104 in accordance with one or more embodiments of the method 200 (e.g., at 206), the first and second propulsion-generating vehicles 106 may be identified for inclusion in one or more groups only if the first and second vehicles 106 remain together in the second vehicle system 104. For example, if a potential group of vehicles 106 supplying at least the amount of power required for the upcoming trip of the second vehicle system 104 would include the first vehicle 106 but not the second vehicle 106, then this consist-busting limitation may prevent the first vehicle 106, the second vehicle 106, and/or both the first and second vehicles 106 from being included in any potential groups of vehicles 106 for the second vehicle system 104. Alternatively, the vehicles 106 in a consist may be separated from each other for inclusion in the groups.

While the preceding constraints provide some limitations on which propulsion-generating vehicles 106 may be included in a group of potential vehicles 106 for an upcoming trip of a vehicle system 104, other constraints may be used and/or one or more of these constraints may not be used.

Returning to the description of the method 200 shown in FIGS. 2A and 2B, at 208, a potential arrangement of vehicles in the vehicle system 104 being formed for an upcoming trip is determined. This potential arrangement can include the identification of propulsion-generating vehicles 106 to include in the vehicle system 104, the identification of non-propulsion-generating vehicles (e.g., railcars) to include in the vehicle system 104, and/or the locations of the propulsion-generating vehicles 106 in the vehicle system 104. The locations of the vehicles 106 can include the positions of the vehicles 106 relative to each other and/or relative to the non-propulsion-generating vehicles in the vehicle system 104. These locations can represent a distribution of the vehicles 106 in the vehicle system 104.

Figure 4:
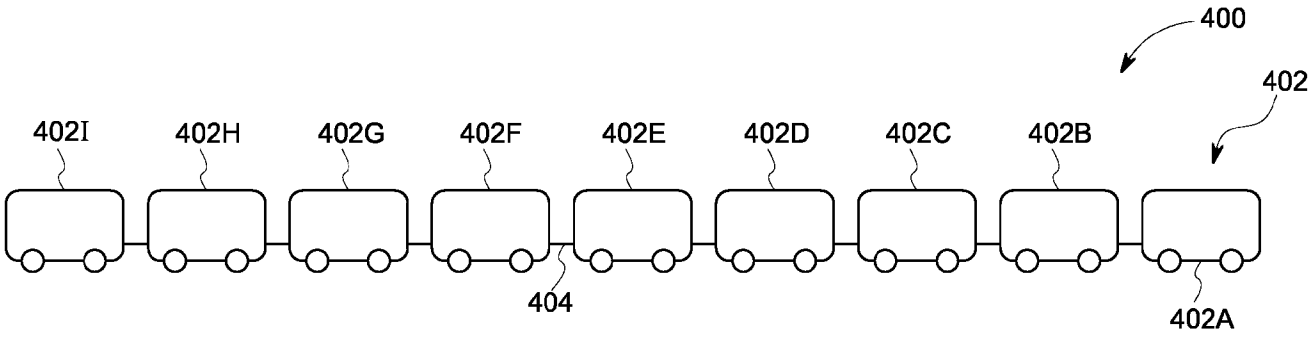
FIG. 4 schematically illustrates a vehicle system according to several examples described herein.

FIG. 4 schematically illustrates a vehicle system 400 according to several examples described herein. The vehicle system 400 can represent one or more of the vehicle systems 104 (shown in FIG. 1) being formed from several vehicles 402 (e.g., vehicles 402A-I) mechanically connected with each other by couplers 404. The vehicles 402 can represent propulsion-generating vehicles 106 and/or non-propulsion-generating vehicles (e.g., railcars).

The method 200 may identify different groups of propulsion-generating vehicles 106 for inclusion in the vehicle system 400 having six non-propulsion-generating vehicles. Optionally, a larger or smaller number of propulsion-generating vehicles and/or non-propulsion-generating vehicles may form the vehicle system 400. As described above, the method 200 may determine the amount of power needed to propel the non-propulsion-generating vehicles for an upcoming trip and the groups of propulsion-generating vehicles 106 may each supply at least this amount of power.

With each group of the propulsion-generating vehicles 106 for potential inclusion in the vehicle system 104, different arrangements of the vehicles 106 may be possible. For example, in a group of three propulsion-generating vehicles 106, a first potential group may include the propulsion-generating vehicles 106 in the locations of the vehicles 402A, 402C, and 4021, with the remaining locations of the vehicles 402B and 402D-H representing non-propulsion-generating vehicles. A different, second potential group may include the propulsion-generating vehicles 106 in the locations of the vehicles 402A and 402D-E, with the remaining locations of the vehicles 402B-C and 402F-I representing non-propulsion-generating vehicles. A different, third potential group may include the propulsion-generating vehicles 106 in other locations and/or may include a larger or smaller number of the vehicles 106 in the vehicle system 400. These different locations and/or numbers of the propulsion-generating vehicles 106 can represent different arrangements of vehicles in the vehicle system 400. Another group of the vehicles 106 may have a different number of the vehicles 106, which also may result in different arrangements of the vehicles 106.

Returning to the description of the method 200 shown in FIGS. 2A and 2B, once a potential arrangement of the propulsion-generating vehicles 106 in a group for the vehicle system 104 is identified, at 210, handling parameters of a vehicle system 104 having the potential arrangement of the vehicles 106 are determined. These handling parameters can represent forces exerted on the couplers, energies stored in the couplers, relative velocities of neighboring vehicles of the vehicles in the vehicle system, natural forces exerted on one or more segments of the vehicle system between two or more of the propulsion-generating vehicles, distances between neighboring vehicles in the vehicle system, momentum of one or more vehicles and/or one or more groups of the vehicles, virtual forces exerted on one or more of the vehicles, or the like. The momentum may include changes in momentum, momentum transport, or the like. One example of handling parameters is coupler parameters. Coupler parameters can include one or combinations of estimates, calculations, measurements, and/or simulations of coupler forces and/or energies stored in the couplers 404 (shown in FIG. 4) at one or more locations along the route during an upcoming trip. In one embodiment, the coupler forces and/or energies stored in the couplers can be estimated from a model of the couplers. For example, the couplers between the vehicles in the vehicle system can be modeled as springs having spring constants k and a damper (e.g., the mass of the vehicles to which the modeled spring is coupled). Due to the tractive efforts (e.g., power outputs) provided by the propulsion-generating vehicles 106, slack in the couplers between the vehicles in the vehicle system 104 may undergo transitions, and the forces exerted on the couplers and/or the energies stored in the couplers that result from these transitions can be calculated (e.g., estimated or simulated) as a function of the tractive efforts provided by the propulsion-generating vehicles at the different locations.

By way of example, a first coupler may be expected to become compressed due to the expected deceleration of a first leading propulsion-generating vehicle 106 and the expected acceleration of a first trailing propulsion-generating vehicle 106 that are caused by changes in the grade of the route during travel according to the trip plan for the upcoming trip (e.g., during traversal of a valley or low point in the route). Another, second coupler may be expected to become stretched due to the expected acceleration of a second leading propulsion-generating vehicle 106 and the expected deceleration of a second trailing propulsion-generating vehicle 106 that are caused by changes in the grade of the route during travel according to the trip plan (e.g., during traversal over a peak or high point in the route). The first coupler may be estimated to have a greater compressive force than the second coupler in this example. In one embodiment, the handling parameters are determined as described in U.S. patent application Ser. No. 14/319,885, the entire disclosure of which is incorporated herein by reference. Alternatively, another technique for determining the handling parameters may be used. For example, travel of a vehicle system 104 having a potential group of propulsion-generating vehicles 106 can be simulated using one or more processors, with the handling parameters determined from the simulated travel.

The handing parameters may be determined at one or more locations along a route for the upcoming trip. One or more combined handling parameters may be determined, such as an average, median, moving average, deviation, or the like, of the handling parameters for a vehicle system at different locations and/or times along the trip.

At 212, a determination is made as to whether one or more additional arrangements of the propulsion-generating vehicles 106 in a group are to be examined. For example, if the method 200 is being applied to examine multiple different potential arrangements of propulsion-generating vehicles in a group being examined, then flow of the method 200 may return to 206 in a loop-wise manner one or more times to examine additional arrangements of the propulsion-generating vehicles 106 in a group being examined. As described above, the different groups that are examined can include different numbers of the propulsion-generating vehicles 106 and/or different locations of the propulsion-generating vehicles 106 in the vehicle system 104. These different numbers and/or locations of the vehicles 106 can result in various arrangements of the vehicles 106.

If there are one or more additional arrangements of the vehicles 106 in the group being examined, then flow of the method 200 can return to 208. Alternatively, if the handling parameters for the different arrangements of the vehicles 106 in a group have been examined, then flow of the method 200 can continue to 214.

At 214, a determination is made as to whether one or more additional groups of the propulsion-generating vehicles 106 are to be examined. As described, different groups of the vehicles 106 may include different vehicles 106, different numbers of the vehicles 106, different consists formed by the vehicles 106, and the like. If another group of the vehicles 106 can provide at least the amount of power needed to complete the scheduled trip according to the trip plan and the handling parameters for different arrangements of the vehicles 106 is this other group have not been examined, then flow of the method 200 can return to 208. The method 200 may then continue in a loop-wise manner to examine the handling parameters for different arrangements of the vehicles 106 in this other group. Alternatively, if there is not another group of vehicles 106 to examine (or an operator has stopped examination of the groups, at least a designated number of groups have been examined, etc.), then flow of the method 200 can continue to 216.

At 216, a group and/or an arrangement of the propulsion-generating vehicles 106 are selected. The group can include the identification of which vehicles 106 are to be included in the vehicle system 104 for the upcoming trip, and the arrangement can identify where these vehicles 106 are to be located in the vehicle system 104 for the upcoming trip. The group and/or arrangement can be selected from among two or more different groups, and/or from two or more different arrangements within the groups, based on comparisons of the handling parameters. For example, a group and arrangement having the smallest handling parameters (or smaller than at least a designated number of groups and/or arrangements, but not the smallest handling parameters) may be selected. Alternatively, a group and/or arrangement of the vehicles 106 may be selected based on how quickly the group and/or arrangement of the vehicles 106 can be combined to form the vehicle system 104. For example, some groups and/or arrangements of the vehicles 106 may be able to be combined into the vehicle system 104 for departure from a vehicle yard sooner than one or more other groups and/or arrangements. If the handling parameters are not significantly worse between two or more different groups and/or arrangements (e.g., the handling parameters do not differ by more than a designated, non-zero threshold), then the group and/or arrangement that can be formed into the vehicle system 104 for an earlier or on-time departure may be selected instead of another group and/or arrangement (that may have smaller handling parameters but would not leave the vehicle yard until a later time).

At 218, the vehicle system 104 with the selected group and/or arrangement of the propulsion-generating vehicles 106 is formed. For example, as shown in FIG. 1, the power assignment system 100 can include one or more output devices 118 that communicate build signals to the yard planning system 116. A build signal can indicate the group and/or arrangement of the propulsion-generating vehicles 106 that are to be included in the vehicle system 104 that actually will depart from the vehicle yard 304 in the upcoming trip. The output device 118 can include one or more processors that form the build signal for communication to the communication unit 110 for transmission and/or broadcast to the yard planning system 116. Optionally, the output device 118 can include a monitor, television, touchscreen, or other device, that informs an operator of the group and/or arrangement of the propulsion-generating vehicles 106. The operator may then instruct the yard planning system 116 on how to include the propulsion-generating vehicles 106 in the vehicle system 104.

The yard planning system 116 may then arrange for the building of the vehicle system 104 to have the selected group and/or arrangement of the propulsion-generating vehicles 106. In one aspect, the yard planning system 116 can formulate schedules, instructions, or the like, for communication to various operators, computers, or other devices in the vehicle yard 304. These schedules, instructions, or the like, can dictate where the different propulsion-generating vehicles 106 are to travel to in the vehicle yard 304 and at what times so that the vehicle system 104 can be formed with the selected group and/or arrangement of the propulsion-generating vehicles 106.

At 218, the vehicle system 104 with the selected group and/or arrangement of the propulsion-generating vehicles 106 can depart the vehicle yard 304 and travel according to the trip plan formed by the energy management system 114. At 220, during travel of the vehicle system 104, a determination may be made as to whether another group and/or arrangement of propulsion-generating vehicles 106 is available for the vehicle system 104. For example, the trip plan may direct the vehicle system 104A (shown in FIG. 3) to travel from the vehicle yard 304A (shown in FIG. 3) to another vehicle yard 304C (shown in FIG. 3). During movement of the vehicle system 104A toward the vehicle yard 304A, the power assignment system 100 (shown in FIG. 1) may communicate with a yard planning system 116 (shown in FIG. 1) of the vehicle yard 304C. The power assignment system 100 may determine which propulsion-generating vehicles 106 are currently at the vehicle yard 304C and/or that are traveling toward the vehicle yard 304C for arrival prior to the vehicle system 104A at the vehicle yard 304C from these communications with the yard planning system 116. If one or more other propulsion-generating vehicles 106 are available and/or will be available at the vehicle yard 304C for inclusion in the vehicle system 104A prior to the vehicle system 104A departing the vehicle yard 304C, then the method 200 may consider whether to change the group and/or arrangement of the propulsion-generating vehicles 106 in the vehicle system 104A.

For example, arrival at the vehicle yard 304A can result in a different supply pool of propulsion-generating vehicles 106 being available when compared to when the vehicle system 104A left the previous vehicle yard 304A. Some propulsion-generating vehicles 106 may be sitting in the vehicle yard 304C and/or one or more other vehicle systems (e.g., vehicle system 104C may arrive at the vehicle yard 304C with additional propulsion-generating vehicles 106 prior to the scheduled departure of the vehicle system 104A from the vehicle yard 304C.

If additional propulsion-generating vehicles 106 are available or will be available prior to departure of the vehicle system 104A from the vehicle yard 304C, then flow of the method 200 may proceed to 222 for consideration of whether to include any of these vehicles 106 in the vehicle system 104A. Alternatively, if additional vehicles 106 are not available prior to departure of the vehicle system 104A from the vehicle yard 304C, then flow of the method 200 can continue to 224.

At 222, a determination of whether the group and/or arrangement of propulsion-generating vehicles 106 in the vehicle system 104A are to be changed at the vehicle yard 304C is made. For example, the vehicles 106 that are at the vehicle yard 304C or heading toward the vehicle yard 304C may provide additional power that can replace and/or augment one or more vehicles 106 currently in the vehicle system 104. This can result in the vehicle system 104A reaching a final destination of the trip faster, one or more intermediate locations of the trip faster, consume less fuel, and/or generate fewer emissions than the current group and/or arrangement of the vehicles 106 in the vehicle system 104A. However, due to scheduling limitations, such as the trip plan or schedule of the vehicle system 104A not allowing sufficient time for the vehicle system 104A to stop at the vehicle yard 304C to change which vehicles 106 are in the vehicle system 104A and/or the arrangement of the vehicles 106 in the vehicle system 104A.

If the group and/or arrangement of the vehicles 106 is to be changed, then flow of the method 200 can return to 206. As described above, the method 200 may then examine different groups and/or arrangements of the vehicles 106 (both that are already in the vehicle system 104A and that will be available at the vehicle yard 304C) to determine if the group and/or arrangement should be changed to improve handling parameters. The method 200 may continue in a loop-wise manner during a trip to repeatedly evaluate and re-evaluate whether to change which propulsion-generating vehicles 106 are included in the vehicle system 104A. At 224, the vehicle system 104A may continue to travel along the trip toward one or more other vehicle yards 304, and/or toward the final destination of the trip.

In one embodiment, in addition to or instead of examining the handling parameters to determine which group and/or arrangement of vehicles 106 to include in the vehicle system 104, the method 200 may examine how closely the vehicle system 104 can abide by a schedule of the trip, how quickly the vehicle system 104 can reach one or more locations, or the like. For example, the vehicles 106 may be selected and/or arranged in the vehicle system 104 so that the vehicle system 104 stays on schedule and/or arrives early to one or more locations.

Determining the groups and/or arrangements of the propulsion-generating vehicles 106 in a vehicle system 104 as described herein can reduce the operating costs of vehicle systems 104 by reducing waste in fuel consumption and/or resource allocations. For example, the method 200 can avoid having too many extraneous or unnecessary propulsion-generating vehicles 106 in a vehicle system 104 that consume more fuel than is necessary, generate more emissions than necessary, and/or that could be better used in another vehicle system 104.

In one embodiment, a method (e.g., for forming vehicle systems) includes determining a needed amount of power for propelling a vehicle system along a route during a trip from a first location to one or more destination locations and identifying one or more propulsion-generating vehicles for inclusion in the vehicle system based on power capabilities of the one or more propulsion-generating vehicles. The power capabilities are representative of amounts of power that the one or more propulsion-generating vehicles are calculated to be capable of providing. The method also can include determining handling parameters of the vehicle system having a first group of the one or more propulsion-generating vehicles generating propulsive force to move the vehicle system along the route during the trip, repeating determining the handling parameters of the vehicle system with the vehicle system having one or more different groups of the one or more propulsion-generating vehicles generating the propulsive force to move the vehicle system along the route during the trip, and selecting the one or more propulsion-generating vehicles in at least one of the first group or the one or more different groups based on the handling parameters. The one or more propulsion-generating vehicles are selected for inclusion in the vehicle system during actual travel of the vehicle system along the route during the trip.

In one aspect, the method also includes determining a position of each of the one or more propulsion-generating vehicles within the vehicle system relative to one or more of each other or one or more non-propulsion-generating vehicles in the vehicle system. The position of each of the one or more propulsion-generating vehicles can be determined based on the power capabilities of the one or more propulsion-generating vehicles.

In one aspect, identifying the one or more propulsion-generating vehicles includes selecting the one or more propulsion-generating vehicles from a pool of propulsion-generating vehicles that are currently available for travel in the vehicle system at a vehicle yard from which the vehicle system will depart for the trip.

In one aspect, identifying the one or more propulsion-generating vehicles includes selecting the one or more propulsion-generating vehicles from a pool of propulsion-generating vehicles that are not currently available for travel in the vehicle system at a vehicle yard but that are scheduled to arrive at the vehicle yard prior to departure of the vehicle system from the vehicle yard.

In one aspect, the vehicle system is scheduled to travel to the vehicle yard from another location, and the method also includes changing which of the one or more propulsion-generating vehicles are included in the vehicle system at the vehicle yard before traveling to the one or more destination locations.

In one aspect, selecting the one or more propulsion-generating vehicles includes determining a first priority of the vehicle system during the trip relative to one or more other priorities of one or more other vehicle systems and selecting the one or more propulsion-generating vehicles for inclusion in the vehicle system based on a comparison between the first priority and the one or more other priorities.

In one aspect, the vehicle system is scheduled to travel along the route during the trip according to a trip plan that designates operational settings of the vehicle system as a function of one or more of time or distance along the route. Selecting the one or more propulsion-generating vehicles for inclusion in the vehicle system can include identifying the one or more propulsion-generating vehicles capable of performing the operational settings designated by the trip plan.

In one aspect, the method also includes repeating one or more of determining the needed amount of power, identifying the one or more propulsion-generating vehicles, determining the handling parameters of the vehicle system, determining the handling parameters, or selecting the one or more propulsion-generating vehicles after the vehicle system arrives at a vehicle yard along the route during the trip. The method also can include changing which of the propulsion-generating vehicles are included in the vehicle system based on the handling parameters that are determined after the vehicle system arrives at the vehicle yard.

In another embodiment, a system (e.g., a power assignment system) includes one or more processors configured to determine a needed amount of power for propelling a vehicle system along a route during a trip from a first location to one or more destination locations. The one or more processors also are configured to identify one or more propulsion-generating vehicles for inclusion in the vehicle system based on power capabilities of the one or more propulsion-generating vehicles. The power capabilities are representative of amounts of power that the one or more propulsion-generating vehicles are calculated to be capable of providing. The one or more processors also can be configured to determine handling parameters of the vehicle system having a first group of the one or more propulsion-generating vehicles generating propulsive force to move the vehicle system along the route during the trip, and to repeat determining the handling parameters of the vehicle system with the vehicle system having one or more different groups of the one or more propulsion-generating vehicles generating the propulsive force to move the vehicle system along the route during the trip. The one or more processors also can be configured to select the one or more propulsion-generating vehicles in at least one of the first group or the one or more different groups based on the handling parameters. The one or more propulsion-generating vehicles are selected for inclusion in the vehicle system during actual travel of the vehicle system along the route during the trip.

In one aspect, the one or more processors are configured to determine a position of each of the one or more propulsion-generating vehicles that are selected for inclusion in the vehicle system based on the power capabilities of the one or more propulsion-generating vehicles.

In one aspect, the one or more processors are configured to select the one or more propulsion-generating vehicles from a pool of propulsion-generating vehicles that are currently available for travel in the vehicle system at a vehicle yard from which the vehicle system will depart for the trip.

In one aspect, the one or more processors are configured to select the one or more propulsion-generating vehicles from a pool of propulsion-generating vehicles that are not currently available for travel in the vehicle system at a vehicle yard but that are scheduled to arrive at the vehicle yard prior to departure of the vehicle system from the vehicle yard.

In one aspect, the vehicle system is scheduled to travel to the vehicle yard from another location. The one or more processors can be configured to change which of the one or more propulsion-generating vehicles are included in the vehicle system at the vehicle yard before traveling to the one or more destination locations.

In one aspect, the one or more processors are configured to determine a first priority of the vehicle system during the trip relative to one or more other priorities of one or more other vehicle systems and to select the one or more propulsion-generating vehicles for inclusion in the vehicle system based on a comparison between the first priority and the one or more other priorities.

In one aspect, the vehicle system is scheduled to travel along the route during the trip according to a trip plan that designates operational settings of the vehicle system as a function of one or more of time or distance along the route. The one or more processors can be configured to identify the one or more propulsion-generating vehicles capable of performing the operational settings designated by the trip plan for inclusion in the vehicle system.

In one aspect, the one or more processors are configured to repeat one or more of determining the needed amount of power, identifying the one or more propulsion-generating vehicles, determining the handling parameters of the vehicle system, repeating determining the handling parameters, or selecting the one or more propulsion-generating vehicles after the vehicle system arrives at a vehicle yard along the route during the trip, and to change which of the propulsion-generating vehicles are included in the vehicle system based on the handling parameters that are determined after the vehicle system arrives at the vehicle yard.

In another embodiment, method (e.g., for forming vehicle systems) includes comparing an amount of tractive power needed to travel to a location along a route using a vehicle system comprising plural non-propulsion-generating vehicles with power capabilities of available propulsion-generating vehicles that are available for inclusion in the vehicle system, and selecting a subset of the available propulsion-generating vehicles for inclusion in the vehicle system. The subset of the available propulsion-generating vehicles provides at least the amount of tractive power needed to travel to the location. The method also can include examining handling parameters of the vehicle system with different arrangements of the available propulsion-generating vehicles in the vehicle system, and selecting a first arrangement of the different arrangements of the available propulsion-generating vehicles for inclusion in the vehicle system during actual travel of the vehicle system along the route toward the location.

In one aspect, the different arrangements dictate positions of the available propulsion-generating vehicles within the vehicle system.

In one aspect, the available propulsion-generating vehicles represent one or more propulsion-generating vehicles that are currently unavailable but that are scheduled to be available for departure from a vehicle yard prior to a scheduled departure of the vehicle system from the vehicle yard.

In one aspect, the available propulsion-generating vehicles represent one or more propulsion-generating vehicles that are scheduled to arrive at an upcoming vehicle yard to which the vehicle system is currently moving toward along the route.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "an embodiment" or "one embodiment" of the inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described systems and methods without departing from the spirit and scope of the inventive subject matter herein involved, it is intended that all of the subject matter of the above description or shown in the accompanying drawings shall be interpreted merely as examples illustrating the inventive concept herein and shall not be construed as limiting the inventive subject matter.

As used herein, a structure, limitation, or element that is "configured to" perform a task or operation is particularly structurally formed, constructed, programmed, or adapted in a manner corresponding to the task or operation. For purposes of clarity and the avoidance of doubt, an object that is merely capable of being modified to perform the task or operation is not "configured to" perform the task or operation as used herein. Instead, the use of "configured to" as used herein denotes structural adaptations or characteristics, programming of the structure or element to perform the corresponding task or operation in a manner that is different from an "off-the-shelf" structure or element that is not programmed to perform the task or operation, and/or denotes structural requirements of any structure, limitation, or element that is described as being "configured to" perform the task or operation.

What is claimed is:

1. A method comprising:

determining, with one or more processors, a needed amount of power for propelling a vehicle system along a route during a trip from a first location to one or more destination locations;

identifying, with the one or more processors, one or more propulsion-generating vehicles for inclusion in the vehicle system based on power capabilities of the one or more propulsion-generating vehicles, the power capabilities representative of amounts of power that the one or more propulsion-generating vehicles are calculated to be capable of providing;

determining, with the one or more processors, handling parameters of the vehicle system having a first group of the one or more propulsion-generating vehicles generating propulsive force to move the vehicle system along the route during the trip;

repeating determining, with the one or more processors, the handling parameters of the vehicle system with the vehicle system having one or more different groups of the one or more propulsion-generating vehicles generating the propulsive force to move the vehicle system along the route during the trip; and selecting, with the one or more processors, the one or more propulsion-generating vehicles in at least one of the first group or the one or more different groups based on the handling parameters, the one or more propulsion-generating vehicles being selected for inclusion in the vehicle system during actual travel of the vehicle system along the route during the trip.

2. The method of claim 1, further comprising determining, with the one or more processors, a position of each of the one or more propulsion-generating vehicles within the vehicle system relative to one or more of each other or one or more non-propulsion-generating vehicles in the vehicle system, the position of each of the one or more propulsion-generating vehicles determined based on the power capabilities of the one or more propulsion-generating vehicles.

3. The method of claim 1, wherein identifying the one or more propulsion-generating vehicles includes selecting, with the one or more processors, the one or more propulsion-generating vehicles from a pool of propulsion-generating vehicles that are currently available for travel in the vehicle system at a vehicle yard from which the vehicle system will depart for the trip.

4. The method of claim 1, wherein identifying the one or more propulsion-generating vehicles includes selecting, with the one or more processors, the one or more propulsion-generating vehicles from a pool of propulsion-generating vehicles that are not currently available for travel in the vehicle system at a vehicle yard but that are scheduled to arrive at the vehicle yard prior to departure of the vehicle system from the vehicle yard.

5. The method of claim 4, wherein the vehicle system is scheduled to travel to the vehicle yard from another location, and further comprising changing, with the one or more processors, which of the one or more propulsion-generating vehicles are included in the vehicle system at the vehicle yard before traveling to the one or more destination locations.

6. The method of claim 1, wherein selecting the one or more propulsion-generating vehicles includes determining, with the one or more processors, a first priority of the vehicle system during the trip relative to one or more other priorities of one or more other vehicle systems and selecting the one or more propulsion-generating vehicles for inclusion in the vehicle system based on a comparison between the first priority and the one or more other priorities.

7. The method of claim 1, wherein the vehicle system is scheduled to travel along the route during the trip according to a trip plan that designates operational settings of the vehicle system as a function of one or more of time or distance along the route, and wherein selecting the one or more propulsion-generating vehicles for inclusion in the vehicle system includes identifying, with the one or more processors, the one or more propulsion-generating vehicles capable of performing the operational settings designated by the trip plan.

8. The method of claim 1, further comprising repeating one or more of determining the needed amount of power, identifying the one or more propulsion-generating vehicles, determining the handling parameters of the vehicle system, determining the handling parameters, or selecting the one or more propulsion-generating vehicles after the vehicle system arrives at a vehicle yard along the route during the trip, and further comprising changing, with the one or more processors, which of the propulsion-generating vehicles are included in the vehicle system based on the handling parameters that are determined after the vehicle system arrives at the vehicle yard.

9. A system comprising:

one or more processors configured to determine a needed amount of power for propelling a vehicle system along a route during a trip from a first location to one or more destination locations, the one or more processors also configured to identify one or more propulsion-generating vehicles for inclusion in the vehicle system based on power capabilities of the one or more propulsion-generating vehicles, the power capabilities representative of amounts of power that the one or more propulsion-generating vehicles are calculated to be capable of providing, wherein the one or more processors also are configured to determine handling parameters of the vehicle system having a first group of the one or more propulsion-generating vehicles generating propulsive force to move the vehicle system along the route during the trip, and to repeat determining the handling parameters of the vehicle system with the vehicle system having one or more different groups of the one or more propulsion-generating vehicles generating the propulsive force to move the vehicle system along the route during the trip, and wherein the one or more processors are configured to select the one or more propulsion-generating vehicles in at least one of the first group or the one or more different groups based on the handling parameters, the one or more propulsion-generating vehicles being selected for inclusion in the vehicle system during actual travel of the vehicle system along the route during the trip.

10. The system of claim 9, wherein the one or more processors are configured to determine a position of each of the one or more propulsion-generating vehicles that are selected for inclusion in the vehicle system based on the power capabilities of the one or more propulsion-generating vehicles.

11. The system of claim 9, wherein the one or more processors are configured to select the one or more propulsion-generating vehicles from a pool of propulsion-generating vehicles that are currently available for travel in the vehicle system at a vehicle yard from which the vehicle system will depart for the trip.

12. The system of claim 9, wherein the one or more processors are configured to select the one or more propulsion-generating vehicles from a pool of propulsion-generating vehicles that are not currently available for travel in the vehicle system at a vehicle yard but that are scheduled to arrive at the vehicle yard prior to departure of the vehicle system from the vehicle yard.

13. The system of claim 12, wherein the vehicle system is scheduled to travel to the vehicle yard from another location, and wherein the one or more processors are configured to change which of the one or more propulsion-generating vehicles are included in the vehicle system at the vehicle yard before traveling to the one or more destination locations.

14. The system of claim 9, wherein the one or more processors are configured to determine a first priority of the vehicle system during the trip relative to one or more other priorities of one or more other vehicle systems and to select the one or more propulsion-generating vehicles for inclusion in the vehicle system based on a comparison between the first priority and the one or more other priorities.

15. The system of claim 9, wherein the vehicle system is scheduled to travel along the route during the trip according to a trip plan that designates operational settings of the vehicle system as a function of one or more of time or distance along the route, and wherein the one or more processors are configured to identify the one or more propulsion-generating vehicles capable of performing the operational settings designated by the trip plan for inclusion in the vehicle system.

16. The system of claim 9, wherein the one or more processors are configured to repeat one or more of determining the needed amount of power, identifying the one or more propulsion-generating vehicles, determining the handling parameters of the vehicle system, repeating determining the handling parameters, or selecting the one or more propulsion-generating vehicles after the vehicle system arrives at a vehicle yard along the route during the trip, and to change which of the propulsion-generating vehicles are included in the vehicle system based on the handling parameters that are determined after the vehicle system arrives at the vehicle yard.

17. A method comprising:

comparing, with one or more processors, an amount of tractive power needed to travel to a location along a route using a vehicle system comprising plural non-propulsion-generating vehicles with power capabilities of available propulsion-generating vehicles that are available for inclusion in the vehicle system;

selecting, with one or more processors, a subset of the available propulsion-generating vehicles for inclusion in the vehicle system, wherein the subset of the available propulsion-generating vehicles provides at least the amount of tractive power needed to travel to the location;

examining, with one or more processors, handling parameters of the vehicle system with different arrangements of the available propulsion-generating vehicles in the vehicle system; and selecting, with one or more processors, a first arrangement of the different arrangements of the available propulsion-generating vehicles for inclusion in the vehicle system during actual travel of the vehicle system along the route toward the location.

18. The method of claim 17, wherein the different arrangements dictate positions of the available propulsion-generating vehicles within the vehicle system.

19. The method of claim 17, wherein the available propulsion-generating vehicles represent one or more propulsion-generating vehicles that are currently unavailable but that are scheduled to be available for departure from a vehicle yard prior to a scheduled departure of the vehicle system from the vehicle yard.

20. The method of claim 17, wherein the available propulsion-generating vehicles represent one or more propulsion-generating vehicles that are scheduled to arrive at an upcoming vehicle yard to which the vehicle system is currently moving toward along the route.

* * * * *